US009328954B2

(12) United States Patent
Kang et al.

(10) Patent No.: US 9,328,954 B2
(45) Date of Patent: May 3, 2016

(54) REFRIGERATOR WITH A COVERING MEMBER ON AN OUTER CASE FOR GUIDING A WATER SUPPLY PIPE

(75) Inventors: Byeong Kook Kang, Gwangju-si (KR); Sang Gyu Jung, Gwangju-si (KR); Sung Cheul Park, Gwangju-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 510 days.

(21) Appl. No.: 13/586,266

(22) Filed: Aug. 15, 2012

(65) Prior Publication Data

US 2013/0047656 A1 Feb. 28, 2013

(30) Foreign Application Priority Data

Aug. 23, 2011 (KR) ..... 10-2011-0083764

(51) Int. Cl.

*F25D 23/02* (2006.01)
*F25D 23/12* (2006.01)
*E05D 11/00* (2006.01)

(52) U.S. Cl.

CPC ..... *F25D 23/028* (2013.01); *E05D 11/0081* (2013.01); *E05Y 2800/10* (2013.01); *E05Y 2900/31* (2013.01); *F25D 23/126* (2013.01); *F25D 2323/024* (2013.01)

(58) Field of Classification Search

CPC ..... F25D 23/126; F25D 2323/024; F25D 23/061; F25D 23/023

USPC ..... 16/334, 309, 312, 303, 330, 341, 344, 16/317, 315; 312/405, 326, 329; 62/339, 62/377, 389

See application file for complete search history.

(56) References Cited

U.S. PATENT DOCUMENTS

| | | | | | |
|---|---|---|---|---|---|
| 3,429,140 | A * | 2/1969 | White | 62/339 |
| 3,834,178 | A * | 9/1974 | Pink | 62/338 |
| 4,036,620 | A * | 7/1977 | Benasutti et al. | 62/338 |
| 4,543,800 | A * | 10/1985 | Mawby et al. | 62/339 |
| 4,739,629 | A * | 4/1988 | True | 62/338 |
| 4,912,942 | A * | 4/1990 | Katterhenry et al. | 62/338 |
| 5,040,857 | A * | 8/1991 | Mandel et al. | 312/405 |
| 5,263,509 | A * | 11/1993 | Cherry et al. | 137/343 |
| 5,522,656 | A * | 6/1996 | Jenkins | 292/79 |
| 5,941,619 | A * | 8/1999 | Stieben et al. | 312/223.6 |
| 7,266,963 | B2 * | 9/2007 | Lee | 62/259.1 |
| 7,281,391 | B2 * | 10/2007 | Marret et al. | 62/389 |
| 8,412,459 | B2 * | 4/2013 | Schoeters et al. | 702/19 |
| 8,721,013 | B2 * | 5/2014 | Gore et al. | 312/405 |
| 2004/0182104 | A1 * | 9/2004 | Choi | 62/389 |
| 2005/0212392 | A1 * | 9/2005 | Jung | 312/405 |
| 2006/0017361 | A1 * | 1/2006 | Rendel et al. | 312/405 |
| 2007/0251261 | A1 * | 11/2007 | Son et al. | 62/390 |
| 2009/0133430 | A1 * | 5/2009 | Roetker et al. | 62/393 |
| 2010/0231111 | A1 * | 9/2010 | Kang et al. | 312/405 |
| 2011/0030412 | A1 * | 2/2011 | Kim | 62/391 |
| 2011/0079037 | A1 * | 4/2011 | Snider et al. | 62/339 |

* cited by examiner

*Primary Examiner* — M. Alexandra Elve
*Assistant Examiner* — Kirstin Oswald
(74) *Attorney, Agent, or Firm* — Staas & Halsey LLP

(57) ABSTRACT

A refrigerator without a kick plate and having an outer case with a water supply pipe at a bottom surface of the outer case. A lower hinge module of a refrigerator includes a body hinge bracket having one portion fixed to the lower surface of the outer case and the remaining portion disposed at the lower portion of the door for supporting the door, a hinge shaft which is protruded from the body hinge bracket and coupled at the lower surface of the door for the door to be capable of rotating and at which a central hole formed for the water supply pipe to pass through, a support member coupled to the lower portion of the body hinge bracket and supported by the bottom surface outside, and a guide unit which is provided along the outer side of the support member.

15 Claims, 10 Drawing Sheets

REFRIGERATOR WITH A COVERING MEMBER ON AN OUTER CASE FOR GUIDING A WATER SUPPLY PIPE

CROSS-REFERENCE TO RELATED APPLICATIONS

This application claims the priority benefit of Korean Patent Application No. 10-2011-0083764, filed on Aug. 23, 2011 in the Korean Intellectual Property Office, the disclosure of which is incorporated herein by reference.

BACKGROUND

1. Field

Example embodiments of the following disclosure relate to a structure of a lower hinge structure of a refrigerator and a disposition of a water supply pipe, and more particularly, to a structure of a lower hinge structure of a refrigerator and a disposition of a water supply pipe, such that the refrigerator having an enhanced exterior appearance by eliminating a kick plate and by disposing the water supply pipe at a bottom surface of an outer case.

2. Description of the Related Art

In general, a refrigerator is an apparatus having a storage compartment and a cold flow supplying apparatus, which is configured to generate and supply a cold flow to the storage compartment, thereby keeping food refrigerated and frozen. The storage compartment of the refrigerator is formed having an open front surface, and a door is installed on a body to open or close the open front surface. The door may be rotatively coupled to the body by an upper hinge module and a lower hinge module with respect to the body.

Such a lower hinge module, in general, is composed of by including a hinge bracket which is bent in about 90 degrees and having one portion fixedly coupled to the front surface of the body and having the remaining portion coupled to the bottom surface of the door in order for the door to be rotatable.

Meanwhile, a dispenser apparatus may be provided in order for the water stored in the storage compartment to be extracted, without having to open the door of the refrigerator.

A water supply pipe configured to supply water to the dispenser apparatus, as such, includes a first water supply pipe having one end connected to the dispenser apparatus and having another end withdrawn to the lower portion of the front surface of the body through the inside of the door, and a second water supply pipe having one end connected to a water tank at the inside of the body and having another end withdrawn to the lower portion of the front surface of the body.

The first water supply pipe and the second water supply pipe are connected to each other and fixed at the lower portion of the front of the body, and a kick plate is coupled to the lower portion of the front of the body in order for the water supply pipe not to be exposed.

An example of such a refrigerator has been suggested in Korean patent publication No. 10-2005-0077582.

SUMMARY

Therefore, it is an aspect of the present disclosure to suggest a refrigerator having an enhanced exterior by eliminating a kick plate that covers a water supply pipe.

It is another aspect of the present disclosure to suggest a refrigerator having an expanded inside capacity and an enhanced exterior by closely positioning a door toward a side of a ground surface.

Additional aspects of the disclosure will be set forth in part in the description which follows and, in part, will be obvious from the description, or may be learned by practice of the disclosure.

In accordance with one aspect of the present disclosure, a refrigerator includes an inner case which is configured to form a storage compartment; a body having an outer case which is configured to form an exterior by being coupled to an outer side of the inner case; a door which is rotatively coupled to the body by an upper portion hinge module and a lower hinge module which is configured for opening/closing the open front surface of the storage compartment; a dispenser which is provided at the door for extracting the water stored at the storage compartment without having to open the door; and a water supply pipe which is configured to pass through the inside of the body and the door for supplying water to the dispenser. The lower hinge module may include a body hinge bracket having one portion fixed to the lower surface of the outer case and the remaining portion disposed at the lower portion of the door for supporting the door, a hinge shaft which is protruded from the body hinge bracket and coupled at the lower surface of the door for the door to be capable of rotating and at which a central hole formed for the water supply pipe to pass through, a support member which is coupled to the lower portion of the body hinge bracket and supported by the bottom surface outside, and a guide unit which is provided along the outer side of the support member for guiding the water supply pipe. The guide unit may include a path which is provided at an inside for the water supply pipe to pass through and coupled to the central hole of the hinge shaft.

In addition, the guide unit may be formed, such that it gradually bends along the outer side of the support member.

In addition, the bottom end of the guide unit may be provided at a higher position than the bottom end of the support member.

In addition, the guide unit may be integrally formed with the body hinge bracket.

In addition, the guide unit may be separately provided from the body hinge bracket and coupled to the lower portion of the body hinge bracket.

In addition, the support member may be separately provided to be closer to the door with respect to the body in order for supporting the door.

In addition, the refrigerator may further include a water tank which is configured to store the water supplied from an outside water supply source; and the water supply pipe includes a first water supply pipe having one end connected to the dispenser and another end withdrawn to the outside of the door after passing through the inside of the door and the lower hinge module, a second water supply pipe having one end connected to the water tank and another end withdrawn to the outside of the outer case after passing through the inside of the outer case, and a third water supply pipe having one end connected to the outside water supply source and another end connected to the water tank after passing through the inside of the outer case. The other end of the first water supply pipe and the other end of the second water supply pipe may be connected to each other and fixed to the bottom surface of the outer case.

Here, a penetration hole may be formed at the bottom surface of the outer case in order for the second water supply pipe to be withdrawn to the outside of the outer case.

Here, the refrigerator may further include a covering member which is coupled to the bottom surface of the outer case in order for guiding the other end of the second water supply pipe, which is withdrawn to the outside of the outer case after passing through the penetration hole, toward the side of the lower hinge module.

Here, the covering member may include a covering member path provided at an inside for the second water supply pipe to pass through.

In addition, the covering member may be provided while having a gap with respect to the power hinge module.

In addition, the refrigerator may further include a fixing member which is coupled to the bottom surface of the outer case in order for the water supply pipe to be fixed to the bottom surface of the outer case.

Here, the fixing member may include a support surface which is closely fixed to the bottom surface of the outer case, dual side surface which are bent at the support surface and configured to form an accommodation unit that accommodates the water supply pipe together with the support surface, and a fixture which is extended from one end of the one side surface of the dual side surfaces toward the other side surface of the dual side surfaces while having a gap with respect to the other side surface.

Meanwhile, the lower hinge bracket may further include a door hinge bracket which is fixed to the bottom surface of the door.

Here, the door hinge bracket may include a hinge shaft insertion hole which is formed in order for the hinge shaft of the body hinge bracket to be inserted into and a stopper unit which is interfered by the body hinge bracket and configured to limit the rotation of the door.

Here, the stopper unit may be disposed at the front of the lower hinge module in order in order for the lower hinge module not to be exposed to the front.

In accordance with other aspect of the present disclosure, a refrigerator includes an inner case which is configured to form a storage compartment; a body having an outer case which is coupled to the outer side of the inner case and forms an exterior; a door which is rotatively coupled to the outer case by the upper hinge module and the lower hinge module to be capable of opening/closing the open front surface of the storage compartment; a support member which is coupled to the bottom surface of the lower hinge module and supported at the bottom surface of the outer case; a dispenser which is provided at the door and configured to extract water stored in the storage compartment from an outside without having to open the door; a water tank which is configured to store the water supplied from an outside water supply source; a first water supply pipe having one end connected to the dispenser and having another end withdrawn to the outside of the door after passing through the inside of the door and the lower hinge module, a second water supply pipe having one end connected to a water tank at the inside of the body and having another end withdrawn to the outside of the outer case, a third water supply pipe having one end connected to the outside water supply source and having another end connected to the water tank after passing through the inside of the outer case, and a water supply pipe which is formed by having the other end of the first water supply pipe and the other end of the second water supply pipe connected to each other and fixed at the bottom surface of the outer case, a guide unit which is provided along the outer side of the support member for guiding the first water supply pipe, and a penetration hole which is formed at the bottom surface of the outer case in order for the second water supply pipe to be withdrawn to the outside of the outer case.

Here, a refrigerator may further include a covering member which is coupled to the bottom surface of the outer case in order for guiding the other end of the second water supply pipe, which is withdrawn to the outside of the outer case after passing through the penetration hole, toward the side of the lower hinge module, and the covering member may be provided while having a gap with respect to the lower hinge module.

In addition, a refrigerator may further include a fixing member which is coupled to the bottom surface of the outer case in order for fixing the water supply pipe to the bottom surface of the outer case.

In accordance with another aspect of the present disclosure, a refrigerator includes an inner case which is configured to form a storage compartment; a body having an outer case which is coupled to the outer side of the inner case and forms an exterior; a door which is rotatively coupled to the outer case by the upper hinge module and the lower hinge module to be capable of opening/closing the open front surface of the storage compartment; a dispenser which is provided at the door and configured to extract water stored in the storage compartment from an outside without having to open the door; and a water supply pipe which connects an outside water supply source and the dispenser for supplying water to the dispenser and penetrates the bottom surface of the outer case.

In accordance with one aspect of the present disclosure, an exterior of a refrigerator may be enhanced by eliminating a kick plate that is installed at a lower portion of a front of a body.

In addition, an inside capacity of and an exterior of a refrigerator may be enhanced exterior by closely positioning a door toward a side of a ground surface.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
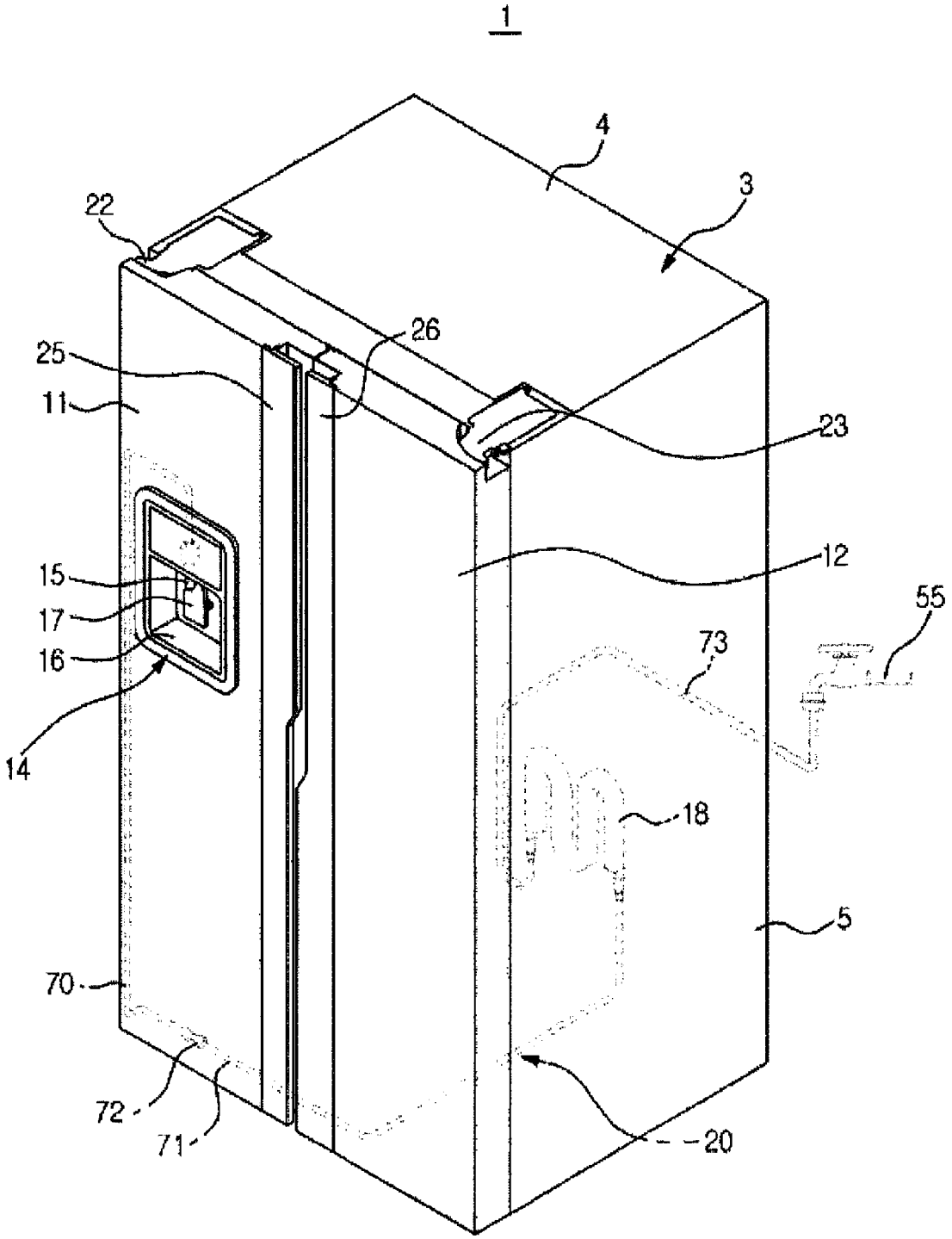
FIG. 1 illustrates an exterior of a refrigerator and a water supply system in accordance with an example embodiment of the present disclosure.

Reference will now be made in detail to the embodiments of the present disclosure, examples of which are illustrated in the accompanying drawings, wherein like reference numerals refer to like elements throughout.

Figure 2:
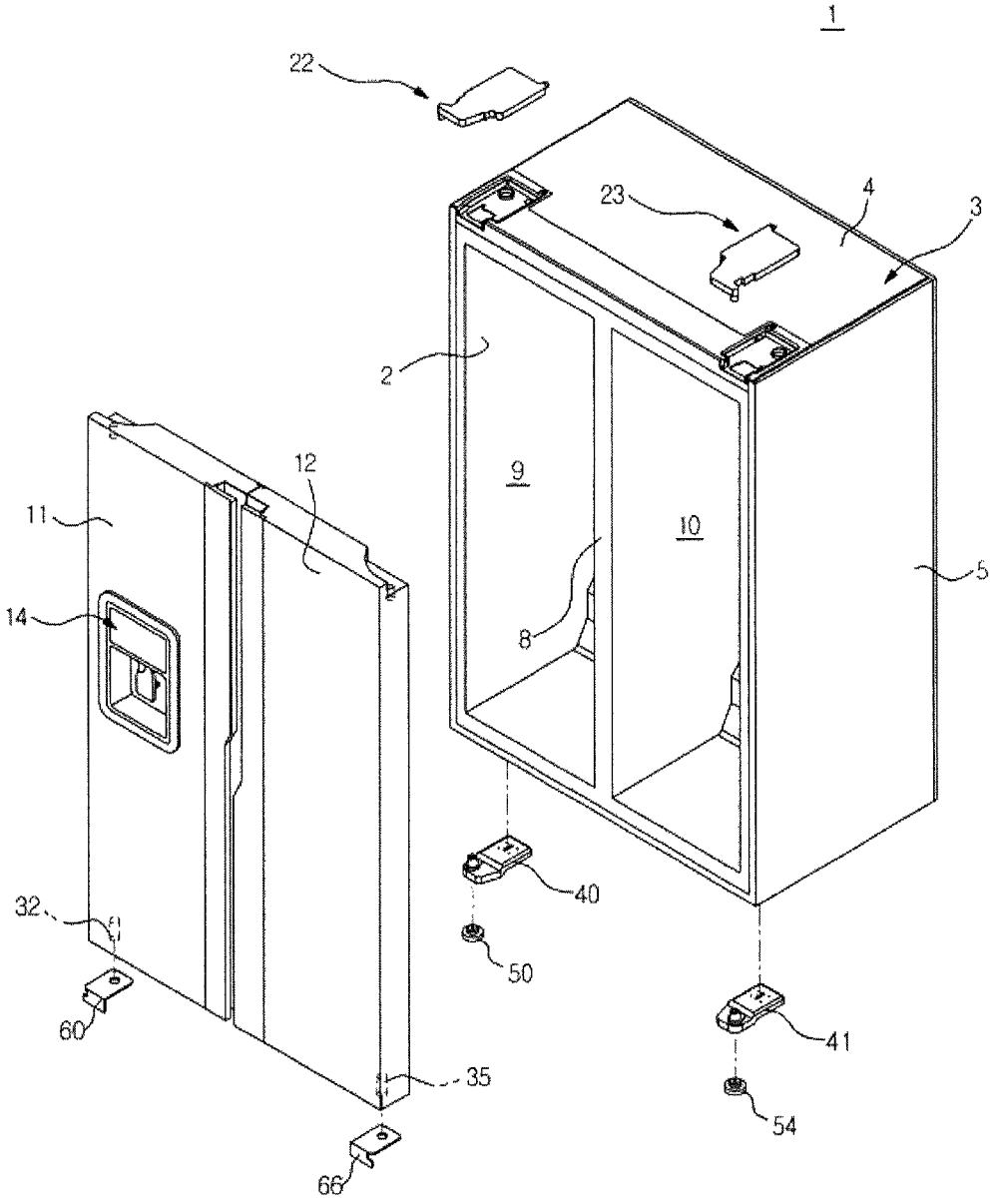
FIG. 2 illustrates a coupling relation of a body and a door of a refrigerator of FIG. 1.

FIG. 1 illustrates an exterior of a refrigerator and a water supply system in accordance with an example embodiment of the present disclosure, and FIG. 2 illustrates a coupling relation of a body and a door of a refrigerator of FIG. 1.

Referring to FIGS. 1 to 2, a refrigerator 1 is composed of by including a storage compartment 9 and 10 in which food is stored, and a cold flow supply apparatus (not shown) configured to supply a cold flow at the storage compartment 9 and 10. The storage compartment 9 and 10 may be divided by a mid wall 8 into a freezing compartment 9 which stores food in a frozen state and a refrigerating compartment 10 which stores food in a refrigerated state. Each of the freezing compartment 9 and the refrigerating compartment 10 is formed by having an open front surface.

The cold flow supply apparatus (not shown) includes a compressor, a condenser, an expansion valve, an evaporator, and a draft fan, and is configured to store the cold flow generated by the evaporation of the refrigerant in the storage compartment 9 and 10.

The refrigerator 1 is further equipped with an inner case 2 which forms the storage compartment 9 and 10, and an outer case 3 which is coupled to an outer side of the inner case 2 and forms an exterior. An insulator is foamed between the inner case 2 and the outer case 3, thereby blocking the cold flow of the inside of the storage compartment 9 and 10 from flowing to outside.

The inner case 2 may be formed with plastic material by considering insulation capacity and manufacturing convenience, and the outer case 3 may be formed with metallic material by considering durability. The outer case 3 may be equipped with a top surface 4, dual side surfaces 5, a bottom surface 6 (FIG. 3), and a rear surface (not shown) in order to cover the inner case 2 at an outside.

Figure 3:
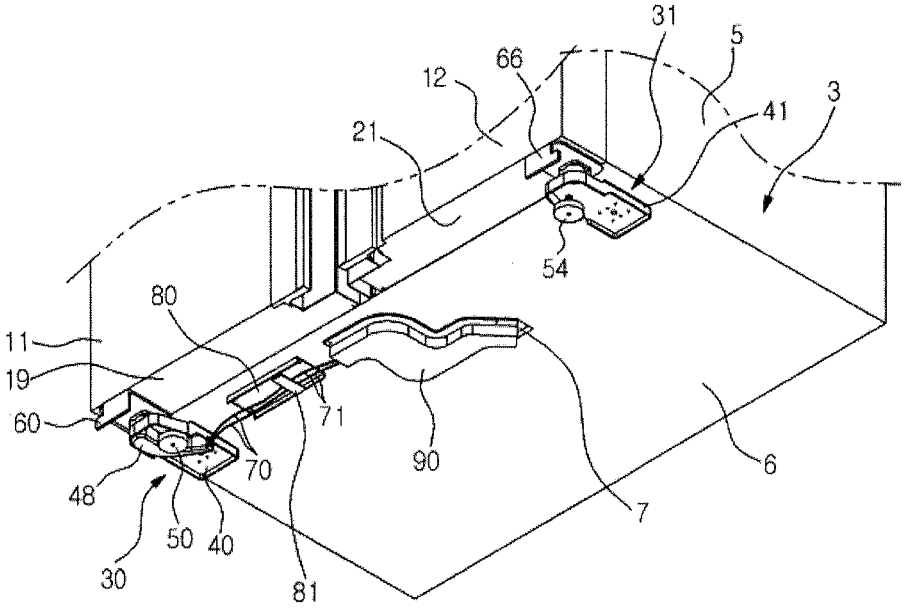
FIG. 3 is a perspective view of a lower surface of a refrigerator of FIG. 1.

Meanwhile, a pair of doors 11 and 12 which open or close the open front surface of the freezing compartment 9 and the refrigerating compartment 10 may be rotatively coupled to the outer case 3 with respect to the outer case 3 by a upper hinge module 22 and 23 and a lower hinge module 30 and 31 (FIG. 3). A handle 25 and 26 may be formed at each of the door 11 and 12 for a user to grip and rotate.

A dispenser 14 may be disposed at the door 11 in order for the water stored at the storage compartment 9 and 10 to be extracted from an outside without having to open the door 11. The dispenser 14 is composed of by including an intake space 16, which is retracted toward an inside of the door 11 for a user to extract water from, an extraction hole 15 from which the water is extracted, and a lever 17 configured to operate the dispenser 14.

The refrigerator may further include a water supply system configured to supply water to the dispenser 14. The water supply system may be composed of by including a water tank 18, which stores the water supplied from an outside water supply source 55 and a water supply pipe 20, which connects the outside water supply source 55, water tank 18 and the dispenser 14 to supply water to the dispenser 14.

Here, the water supply pipe 20 may include a first water supply pipe 70 having one end connected to the dispenser 14 and another end withdrawn to the outside of the door 11 after passing through the inside of the door 11, a second water supply pipe 71 having one end connected to the water tank 18 and another end withdrawn to the outside of the outer case 3 after passing through the inside of the outer case 3, and a third water supply pipe 73 having one end connected to the outside water supply source 55 and another end connected to the water tank 18 after passing through the inside of the outer case 3. In addition, the first water supply pipe 70 and the second water supply pipe 71 may be connected to each other by a connector 72. More details with reference to the water pipe 20 will be explained later.

Figure 4:
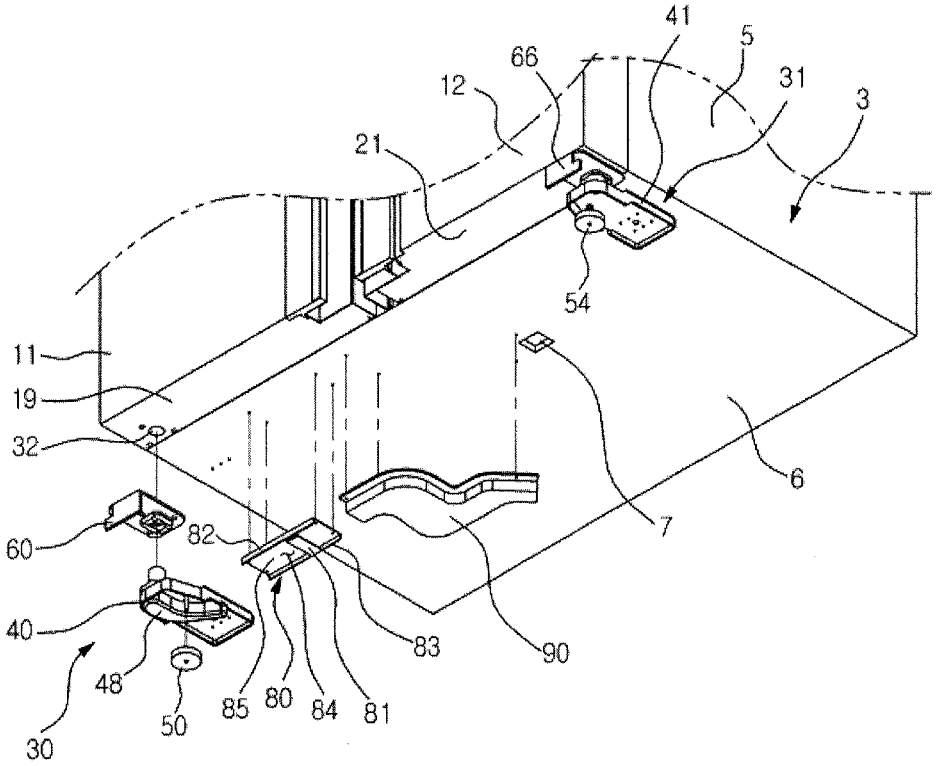
FIG. 4 is a low surface perspective view of a coupling relation of a body and a lower structure of a refrigerator of FIG. 1.
Figure 5:
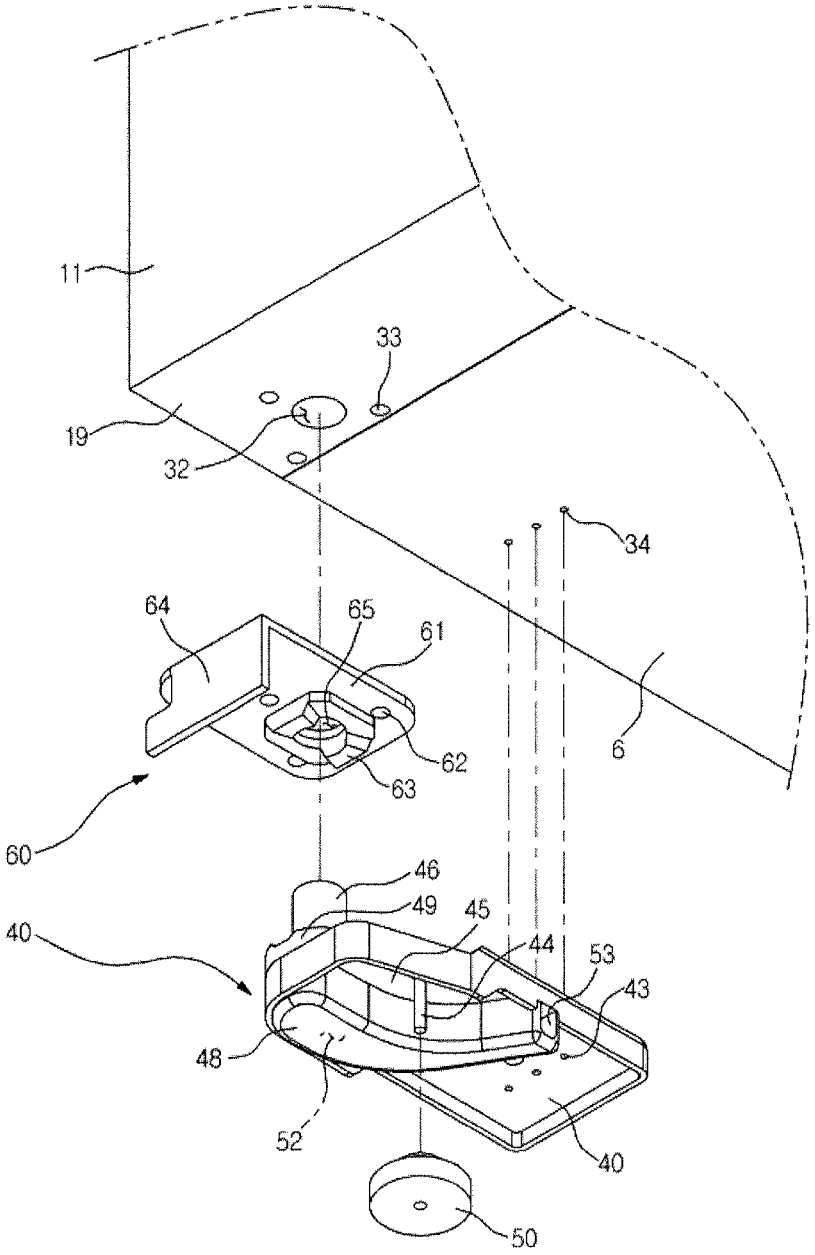
FIG. 5 is a perspective view of a low surface structure of a lower hinge module of a refrigerator of FIG. 1.
Figure 6:
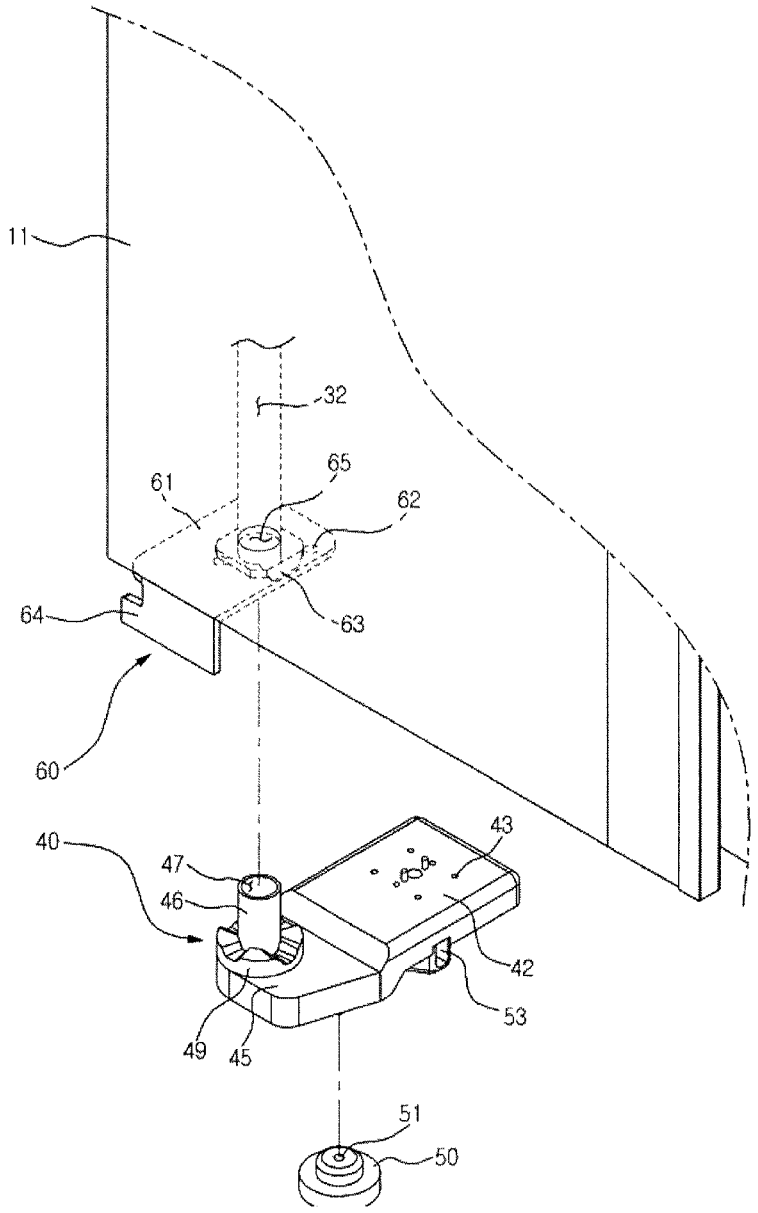
FIG. 6 is a perspective view of a structure of a lower hinge module of a refrigerator of FIG. 1.
Figure 7:
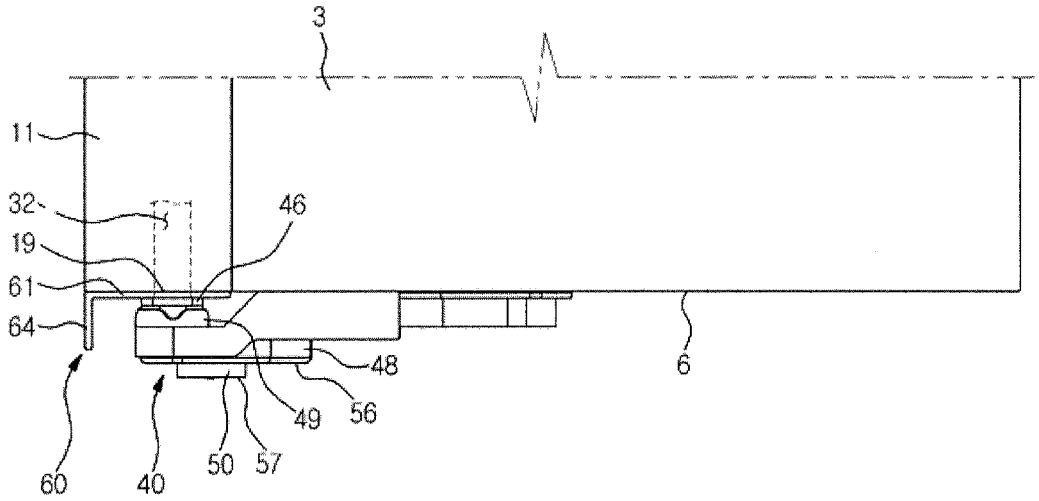
FIG. 7 is a side view of a refrigerator of FIG. 1.
Figure 8:
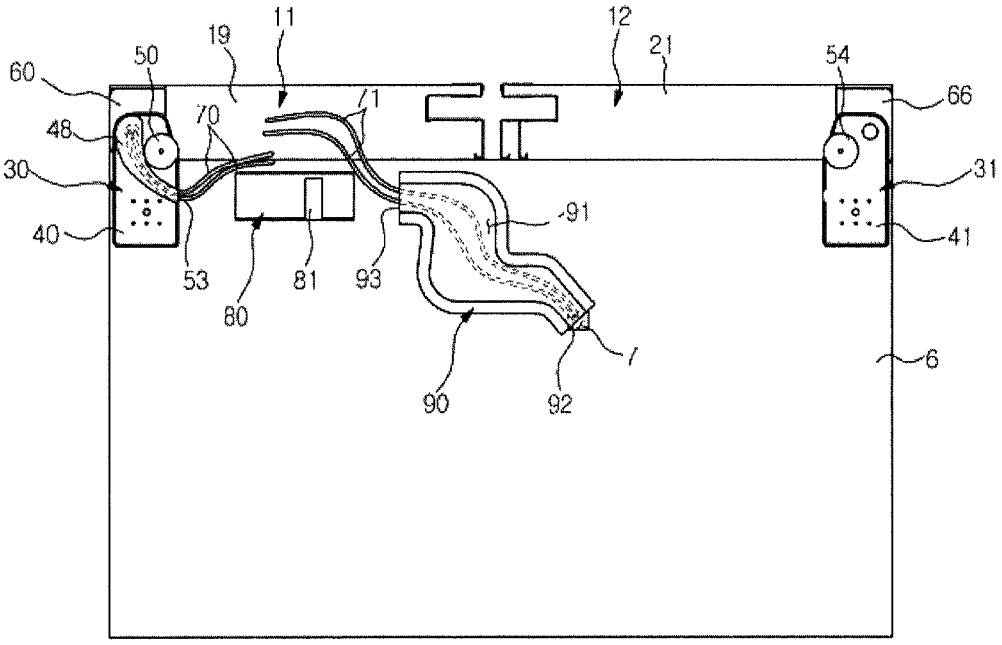
FIGS. 8 to 10 are drawings to explain an assembly method of a water supply pipe of a refrigerator.

FIG. 3 is a perspective view of a lower surface of a refrigerator of FIG. 1, FIG. 4 is a low surface perspective view of a coupling relation of a body and a lower structure of a refrigerator of FIG. 1, FIG. 5 is a perspective view of a low surface structure of a lower hinge module of a refrigerator of FIG. 1, FIG. 6 is a perspective view of a structure of a lower hinge module of a refrigerator of FIG. 1, and FIG. 7 is a side view of a refrigerator of FIG. 1.

Referring to FIGS. 3 to 7, the lower hinge module 30 and 31 rotatively couples the door 11 and 12 to the outer case 3 by connecting a bottom surface 19 and 21 of the door 11 and 12 with a bottom surface 6 of the outer case 3.

The lower hinge module on the left 30 is composed of by including a body hinge bracket 40, a door hinge bracket 60, a support member 50 and a guide unit 48, and the lower hinge module on the right 31 may be composed of by including a body hinge bracket 41, a door hinge bracket 66, and a support member 54.

Since the structure of the lower hinge module 30 on the left and the lower hinge module on the right 31, other than the structure of the guide unit 48, is the same, the lower hinge module on the left 30 will only be explained hereafter and the explanation on the lower hinge module on the right 31 will be omitted.

The body hinge bracket 40 is composed of by including an outer case coupling unit 42 which is fixed to the bottom surface of the outer case 3 and a hinge shaft support unit 45 which is protruded from the outer case coupling unit 42 toward the door 11. The outer case coupling unit 42 and the hinge shaft support unit 45 are disposed at an approximately lateral position with respect to each other.

An outer case coupling hole 34 is formed the outer case coupling unit 42, that is, at the position corresponding to a fastening hole 34 formed at the bottom surface 6 of the outer case 3, thereby enabling the outer case coupling unit 42 to be fixedly coupled to the bottom surface 6 of the outer case through the coupling member.

A hinge shaft 46 having a central hole 47 may be protrudedly formed at the top surface of the hinge shaft support unit 45 in order for a hinge door water supply pipe 70 to pass through. In addition, a support member coupling shaft 44 may be protrudedly formed at the bottom surface of the hinge shaft support unit 45 in order for the support member 50, which is supported by the ground surface, to be coupled.

The support member coupling shaft 44 may be inserted and coupled to a support member groove 51 formed at the support member 50. A male screw unit is formed at the outer circumferential surface of the support member coupling shaft 44, and a female screw unit is formed at the inner circumferential surface of the support member groove 51 in order for the support member 50 to be coupled to the support member coupling shaft by a screw. Here, the support member 50, as illustrated on FIG. 7, may be disposed while having its center closer to the door 11 than to the outer case 3 for preventing the door 11 from sinking.

Meanwhile, a lower cam 49 may be provided around the hinge shaft 46 for covering the hinge shaft 46. The lower cam 49 acts with an upper cam 63, which is to be explained later, to apply a force toward an opening direction or toward a closing direction of the door 11, according to a rotation angle.

The door hinge bracket 60 may be composed of by including a door coupling unit 61 fixed to the bottom surface 19 of the door 11 and the stopper unit 64 bendedly formed at the door coupling unit 61.

A door coupling hole 62 is formed at the door coupling unit 61, that is, at the position corresponding to a fastening hole 33 formed at the bottom surface 19 of the door 11, thereby enabling the door coupling unit 61 to be fixed to the bottom surface 19 of the door by the coupling member.

In addition, a hinge shaft insertion hole 65 may be formed at the door coupling unit 61 in order for the hinge shaft 46 to be inserted at the insertion hole 32 of the door 11 after penetrating the hinge shaft insertion hole 65. The upper cam 63 may be provided around the hinge shaft insertion hole 65, in corresponding to the lower cam 49, to apply a rotating force at the door 11.

The stopper unit 64, when the door 11 rotates by a certain degree, limits the rotation angle of the door 11 by being interfered with the body hinge bracket 40. In addition, the stopper unit 64, when the door 11 is closed, may be disposed at the front of the lower hinge module 30 in order for the lower hinge module 30 not to be exposed to the front.

Meanwhile, the guide unit 48 may be disposed along the outer side of the support member 50 in order to guide the other end of the first water supply pipe 70 having the one end connected to the dispenser 14 after passing through the inside of the door 11 and the central hole 47 of the hinge shaft 46. The guide unit 53 is bendedly formed along the outer side of the support member 50, and a path 52 is formed at an inside in order for the first water supply pipe 70 to pass through.

The entrance of the path 52 is connected to the central hole 47 of the hinge shaft 46, and the exit of the path 52 may be provided in the approximate direction from the side surface 5 toward an inner side of the outer case 3. Therefore, the other end of the first water supply pipe 70 that passed through the inside of the door 11 and the central hole 47 of the hinge shaft 46 may be guided toward an inner side direction through the guide unit 53.

The first water supply pipe 70 that passed through the central hole 47 of the hinge shaft 46 and is withdrawn below the hinge shaft 46 passes the path 52 of the inside of the guide unit 53, thereby not exposed to the outside, and therefore, an appearance is enhanced and a damage of the first water supply pipe 70 by an outside contact may be prevented.

The guide unit 48 as such may be integrally formed with the body hinge bracket 40, or may be separately provided from the body hinge bracket 40 and coupled to the bottom surface of the body hinge bracket 40.

Meanwhile, a penetration hole 7 is formed at the bottom surface 6 of the outer case 3 in order for the second water supply pipe 71 to be withdrawn to the below of the bottom surface 6 of the outer case 3 after penetrating the bottom surface 6 of the outer case 3. Therefore, the one end of the second water supply pipe 71 is connected to the outside water supply source 55 and the other end of the second water supply pipe 71 may be withdrawn to the outside of the outer case 3 through the penetration hole 7 after passing through the inside of the outer case 3.

In order to guide the other end of the second water supply pipe 71 as such, a covering member 90 may be fixedly coupled to the bottom surface 6 of the outer case 3. The covering member 90 may be fixedly coupled to the bottom surface 6 of the outer case 3 by various methods.

A covering member path 91 may be formed at the inside of the covering member 90 in order for the second water supply pipe 71 to pass through, and the entrance 92 of the covering member path 91 is adjacently provided at the penetration hole 7, and the exit 93 of the covering member path 91 may be approximately provided in the direction of the exit 53 of the guide unit 48. Therefore, the other end of the second water supply pipe 71 may be withdrawn through the covering member path 90 approximately toward the direction of the exit 52 of the guide unit 48.

By the covering member 90, the second water supply pipe 71 is not in contact with the ground surface even in the state of a withdrawal to the outside of the outer case 3, thereby preventing a scratch or damage by the ground surface.

In addition, the covering member 90 may be provided while having a gap with respect to the guide unit 48, that is, the lower hinge module 30, in order for a user to connect the one end of the first water supply pipe 70 withdrawn through the exit 53 of the guide unit 48 with the other end of the second water supply pipe 71 by using the connector 72.

Meanwhile, a fixing member 80 may be coupled to the bottom surface 7 of the outer case 3 in order for the first water supply pipe 70 connected through the connector 72 and the second water supply pipe 71 to be fixed to the bottom surface 7 of the outer case 3. The fixing member 80 may be provided approximately in between the lower hinge module 30 and the covering member 90. The fixing member 80 may also be fixedly coupled to the bottom surface 7 of the outer case 3 by various methods.

The fixing member 80, as illustrated on FIG. 4, may be composed of by including a support surface 85 which is closely fixed to the bottom surface 7 of the outer case 3, dual side surfaces 82 and 83 which are bent at the support surface 85, an accommodation unit 84 which is formed between the support unit 85 and the dual side surfaces 82 and 83, and a fixture 81 which is configured to fix the water supply pipe accommodated at the accommodation unit 84.

The fixture 81 is extendedly formed toward the direction of the other side surface 82 from one end of the one side surface 83 while having a gap from the other side surface 82 in order for the first water supply pipe 70 and the second water supply pipe 71 to be inserted to the accommodation unit 84 through the space between the fixture 81 and the other side surface 82.

As such, the first water supply pipe 70 and the second water supply pipe 71 that are withdrawn to the outside of the outer case 3 by the fixing member 80 may be fixed to the bottom surface 6 of the outer case 3, thereby preventing a damage and enhancing an appearance of the refrigerator.

Meanwhile, as previously explained, with reference to the refrigerator in accordance with an example embodiment of the present disclosure, since the lower hinge module 30 is connected to the bottom surface 19 of the door 11 and to the bottom surface 6 of the outer case 3, each of the first water supply pipe 70 and the second water supply pipe 71 is fixed to the bottom surface 3 of the outer case 3 by being withdrawn to the below of the bottom surface 6 of the outer case 3, thereby enabling the door 11 to be closely positioned toward the ground surface while a conventional kick plate is eliminated and instead, the bottom surface 19 of the door 11 is disposed to be in contact with the bottom surface 3 of the outer case 3. Therefore, not only the exterior appearance of the refrigerator is enhanced, but also the inside capacity of the storage compartment 9 and 10 may be improved.

Hereafter, referring to FIGS. 1 to 10, in accordance with an embodiment of the present disclosure, an assembly method of the first water supply pipe 70 and the second water supply pipe 71 of the refrigerator will be explained. The other end of the first water supply pipe 70, having the one end connected to the dispenser 14 and passed through the inside of the door 11 and the hinge shaft 46, is withdrawn to the outside of the outer case 3 through the guide unit 48.

The other end of the second water supply pipe 71, having the one end connected to the outside water supply source 55 and passed through the inside of the outer case 3, is withdrawn to the outside of the outer case 3 through the penetration hole 7 formed at the bottom surface 6 of the outer case 3 and through the covering member 90 coupled to the bottom surface 6 of the outer case 3.

Figure 9:
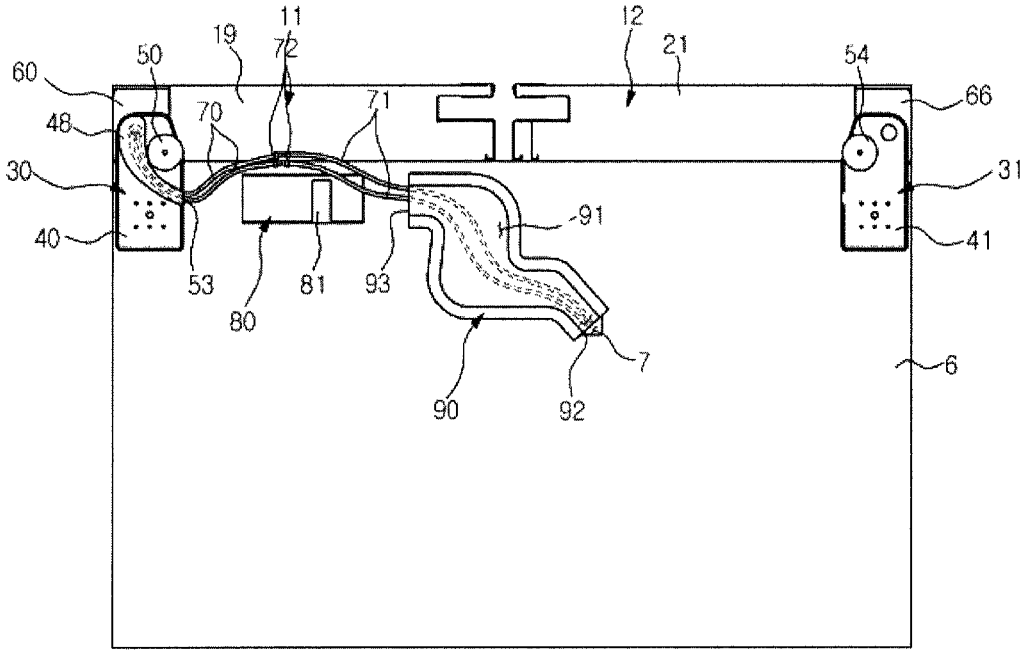
Figure 10:
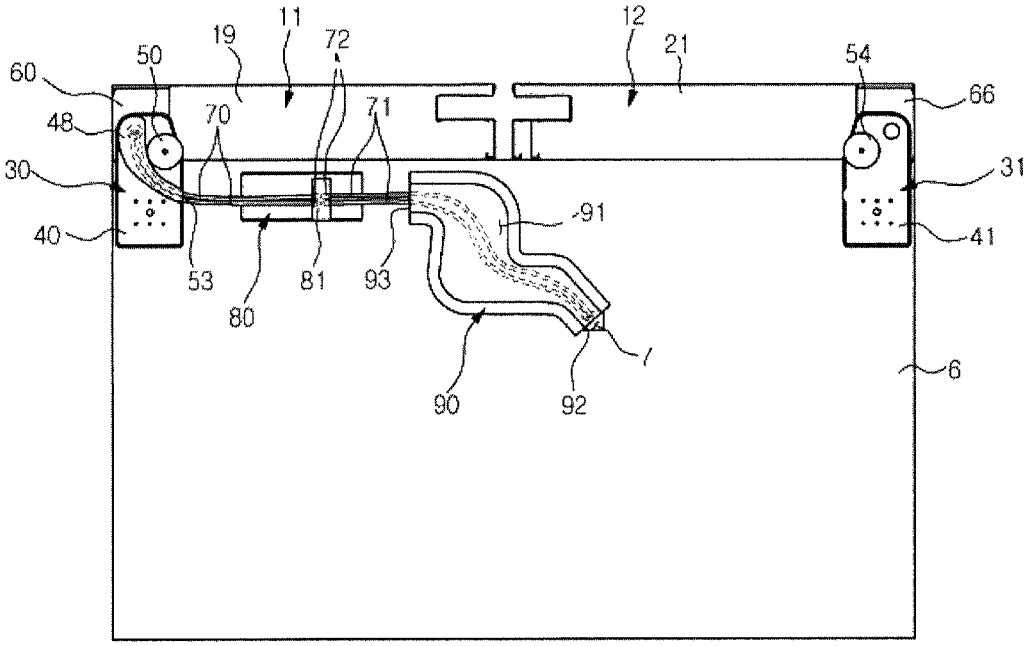

As illustrated on FIG. 9, the other end of the first water supply pipe 70 withdrawn and the other end of the second water supply pipe 71 are connected through the connector 72 and fixed by inserting at the accommodation unit 84 of the fixing member 80.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator, comprising:

a body having an inner case which is configured to form a storage compartment and an outer case which is configured to form an exterior by being coupled to an outer side of the inner case;

a door which is rotatively coupled to the body by an upper portion hinge module and a lower hinge module which is configured for opening or closing an open front surface of the storage compartment;

a dispenser which is provided at the door for extracting water stored at the storage compartment without having to open the door;

a water supply pipe which is configured to pass through an inside of the body and the door for supplying water to the dispenser; and a covering member which is coupled to a lower surface of the outer case in order to guide the water supply pipe so that the water supply pipe is led to the outside of the outer case, and the lower hide module comprising:

a body hinge bracket having an upper portion which faces toward the lower surface of the outer case and a lower portion which faces toward a ground surface, the upper portion of the body hinge bracket includes a portion fixed to the lower surface of the outer case and another portion disposed at a lower portion of the door for supporting the door, a hinge shaft which is protruded from the body hinge bracket and coupled at the lower surface of the door for the door to be capable of rotating and at which a central hole is formed for the water supply pipe to pass through, a support member coupled to the lower portion of the body hinge bracket and configured to be in contact with the ground surface, and a guide unit which is disposed at the lower portion of the body hinge bracket and provided along an outer side of the support member for guiding the water supply pipe, wherein the guide unit comprises a path which is provided at an inside for the water supply pipe to pass through and coupled to the central hole of the hinge shaft.

2. The refrigerator of claim 1, wherein the guide unit is bendedly formed in a curved manner along the outer side of the support member.

3. The refrigerator of claim 1, wherein a bottom end of the guide unit is provided at a higher position than a bottom end of the support member.

4. The refrigerator of claim 1, wherein the guide unit is integrally formed with the body hinge bracket.

5. The refrigerator of claim 1, wherein the guide unit is separately provided from the body hinge bracket and coupled to the lower portion of the body hinge bracket.

6. The refrigerator of claim 1, wherein the support member is separately provided to be closer to the door with respect to the body in order to support the door.

7. The refrigerator of claim 1, wherein the lower module further comprising a door hinge bracket which is fixed to the bottom surface of the door.

8. The refrigerator of claim 7, wherein the door hinge bracket comprising a hinge shaft insertion hole which is formed in order for the hinge shaft of the body hinge bracket to be inserted into, and a stopper unit interfered by the body hinge bracket and configured to limit the rotation of the door.

9. The refrigerator of claim 8, wherein the stopper unit is disposed at the front of the lower hinge module in order for the lower hinge module not to be exposed to the front.

10. The refrigerator of claim 1, wherein the guide unit is formed in the curved manner such that the path which is provided at the inside for the water supply pipe to pass through is curved around a vertical axis of a support member coupling shaft coupled to the support member.

11. A refrigerator, comprising:

a body having an inner case configured to form a storage compartment and an outer case that is configured to form an exterior by being coupled to an outer side of the Inner case;

a door which is rotatively coupled to the outer case by an upper hinge module and a lower hinge module to be capable of opening or closing an open front surface of the storage compartment;

a support member that is coupled to a bottom surface of the lower hinge module and is configured to be in contact with a ground surface;

a dispenser which is provided at the door and configured to extract water stored in the storage compartment from an outside without having to open the door;

a water tank which is configured to store water supplied from an outside water supply source;

a water supply pipe comprising a first water supply pipe having one end connected to the dispenser and having another end withdrawn to the outside of the door after passing through the inside of the door and the lower hinge module, a second water supply pipe having one end connected to the water tank at the inside of the body and having another and withdrawn to the outside of the outer case, and a third water supply pipe having one end connected to the outside water supply source and having another end connected to the water tank after passing through the inside of the outer case, the other end of the first water supply pipe and the other end of the second water supply pipe being connected to each other and fixed at an outer side of a bottom surface of the outer case;

a guide unit that is disposed along the outer side of the support member to guide the first water supply pipe; and a penetration hole formed at the bottom surface of the outer case in order for the second water supply pipe to be withdrawn to the outside of the outer case; and a covering member which is coupled to the bottom surface of the outer case in order to guide the other end of the second water supply pipe so that the second water supply pipe is led to the outside of the outer case after passing through the penetration hole, toward a side of the lower hinge module, wherein the outer side of the bottom surface of the outer case is arranged to face toward the ground surface.

12. The refrigerator of claim 11, wherein the covering member is provided while having a gap with respect to the lower hinge module.

13. The refrigerator of claim 12, further comprising:

a fixing member which is coupled to the bottom surface of the outer case in order to fix the water supply pipe to the bottom surface of the outer case.

14. A refrigerator, comprising:

a body having an inner case that is configured to form a storage compartment and an outer case that is configured to form an exterior by being coupled to an outer side of the inner case;

a door that is rotatively coupled to the outer case by an upper hinge module and a lower hinge module to be capable of opening or closing an open front surface of the storage compartment;

a dispenser that is provided at the door and configured to extract water stored in the storage compartment from an outside without having to open the door;

a water supply pipe that connects an outside water supply source and the dispenser for supplying water to the dispenser and penetrates a bottom surface of the outer case; and a covering member which is coupled to the bottom surface of the outer case in order to guide the water supply pipe so that the water supply pipe is led to the outside of the outer case, and wherein the lower hinge module comprises a body hinge bracket having one portion fixed to an outer side of the bottom surface of the outer case and another portion disposed at a lower portion of the door for supporting the door, a hinge shaft that is protruded from the body hinge bracket and coupled at the lower surface of the door for the door to be capable of rotating and at which a central hole is formed for the water supply pipe to pass through, a support member coupled to the lower portion of the body hinge bracket and configured to be in contact with a ground surface, and a guide unit that is provided along an outer side of the support member for guiding the water supply pipe, wherein the outer side of the bottom surface of the outer case is arranged to face toward the ground surface.

15. The refrigerator of claim 14, wherein the water supply pipe further comprising a first water supply pipe having one end connected to a dispenser and another end withdrawn to an outside of a door after passing through an inside of the door and the lower hinge module, a second water supply pipe having one end connected to the water tank and another end withdrawn to an outside of an outer case after passing through an inside of the outer case, and a third water supply pipe having one end connected to the outside water supply source and another end connected to the water tank after passing through the inside of the outer case, and the other end of the first water supply pipe and the other end of the second water supply pipe is connected to each other and fixed to the bottom surface of the outer case.

* * * * *